US006877487B2

(12) United States Patent
Vogt et al.

(10) Patent No.: US 6,877,487 B2
(45) Date of Patent: Apr. 12, 2005

(54) METHOD, DEVICE AND COMPUTER PROGRAM FOR OPERATING AN INTERNAL COMBUSTION ENGINE, AND INTERNAL COMBUSTION ENGINE

(75) Inventors: Bernhard Vogt, Boeblingen (DE); Achim Guenther, Stuttgart (DE); Manfred Hundhausen, Bietigheim-Bissingen (DE); Thomas Wenzler, Heimsheim (DE)

(73) Assignee: Robert Bosch GmbH, Stuttgart (DE)

( * ) Notice: Subject to any disclaimer, the term of this patent is extended or adjusted under 35 U.S.C. 154(b) by 39 days.

(21) Appl. No.: 10/399,539

(22) PCT Filed: Oct. 17, 2001

(86) PCT No.: PCT/DE01/03966

§ 371 (c)(1),
(2), (4) Date: Apr. 18, 2003

(87) PCT Pub. No.: WO02/33241

PCT Pub. Date: Apr. 25, 2002

(65) Prior Publication Data

US 2004/0020473 A1 Feb. 5, 2004

(30) Foreign Application Priority Data

Oct. 18, 2000 (DE) ..... 101 51 550
Sep. 29, 2001 (DE) ..... 101 48 346

(51) Int. Cl.[7] ..... F02M 51/00
(52) U.S. Cl. ..... 123/490; 251/129; 701/101
(58) Field of Search ..... 123/490; 251/129; 701/101, 103, 104

(56) References Cited

U.S. PATENT DOCUMENTS 4,082,066 A 4/1978 Long
4,132,195 A * 1/1979 Bianchi et al. ..... 123/482
4,378,775 A * 4/1983 Straubel et al. ..... 123/458
4,869,218 A * 9/1989 Fehlmann et al. ..... 123/357

FOREIGN PATENT DOCUMENTS

DE 196 06 965 8/1997
DE 198 59 281 6/2000
EP 1 024 274 8/2000

* cited by examiner

*Primary Examiner*—John T. Kwon
(74) *Attorney, Agent, or Firm*—Walter Ottesen

(57) ABSTRACT

An internal combustion engine (10) is operated by a method wherein the fuel is supplied via a magnetic valve (28) having a coil (34). The injected fuel quantity is influenced by the duration of the drive of the magnetic valve (28). In the method, the temperature (evtmod) of a region (26) of the magnetic valve (28) is determined and the drive duration is corrected in dependence upon temperature. In order to make the correction still more precise, a temperature (evtmod) of the magnetic valve (28) is determined from at least one usually measured temperature (tans, tmot) and the drive duration (ti_tvu_w) is so corrected (tvsp_w) that the temperature dependency of the characteristics of the magnetic coil (34) of the magnetic valve (28) is considered. Furthermore, a model is suggested in which (starting from an operating temperature) the temperature trace is simulated after shut-off of the engine and/or for the restart of the engine by means of two factors for the warmup and cool down.

15 Claims, 4 Drawing Sheets

METHOD, DEVICE AND COMPUTER PROGRAM FOR OPERATING AN INTERNAL COMBUSTION ENGINE, AND INTERNAL COMBUSTION ENGINE

This application is the national stage of International Application No. PCT/DE01/03966, filed Oct. 17, 2001, designating the United States.

FIELD OF THE INVENTION

Background of the Invention

Such a method is known from German patent publication DE 196 06 965. Here, one proceeds from the condition that the viscosity of the fuel (this applies especially to diesel fuel) influences the injected fuel quantity for the same injection time. In order to nonetheless be able to inject a fuel quantity as optimally as possible, the temperature of the fuel is determined from the temperature of a region of the magnetic valve which, in turn, is set equal to the temperature of the magnetic coil of the magnetic valve. This temperature is determined in that the electric resistance of the coil is measured.

Another method is known from the marketplace. With this method, the temperature of the air in the region of the location from which injection takes place is modeled from the temperature of the engine as well as the temperature of the intake air which is supplied to the engine. This modeled temperature is utilized for determining the air charge of the combustion chamber.

Furthermore, it is likewise known from the marketplace to correct the opening time of the magnetic valve by a valve delay time which is dependent upon the battery voltage. In this way, consideration is given to the situation that the valve opening time is dependent upon the battery voltage which, for example, can drop directly when starting so that not sufficient fuel would reach the combustion chamber because of an opening time of the valve which is too short.

In all of the above-mentioned methods, it was, however, determined that deviations of the actual mixture from the desired mixture nonetheless occur. This is compensated by a lambda controller and a mixture adaptation which adjusts the mixture very rapidly to the desired ratio. In order, however, to be able to detect system faults in the mixture preparation, the mixture adaptation operates within a tolerance band fixed by limits. If this band is exceeded because of an especially strong mixture adaptation, then a corresponding fault announcement takes place. Here, it was determined that a strong intervention of the mixture adaptation beyond the limits and the corresponding fault announcement would repeatedly also take place in a system whose components were apparently fault free.

SUMMARY OF THE INVENTION

The present invention therefore has the task to so improve a method of the kind described initially herein that unnecessary fault announcements, which are intended to indicate a fault in the mixture preparation, are avoided as best as possible. The method should be operable as simply and cost effectively as possible.

This task is solved in that a temperature of the magnetic valve is determined from at least one usually measured temperature and the drive duration is corrected in dependence upon the determined temperature so that the temperature dependency of the characteristics of the magnetic coil of the magnetic valve is considered.

The present invention relates further to a method, an arrangement and a computer program for operating an internal combustion engine wherein a temperature model is utilized which estimates the temperature of the fuel rail or of the injection valve(s) for a new start of the engine and wherein a correction of the drive duration with a new start takes place in dependence upon this estimated temperature.

An omitted or too imprecise determination of this temperature has also considerable disadvantages with hot start conditions. Under these conditions, the precontrol of the lambda control is often too imprecise because, inter alia, the occurring temperature conditions are not precisely present so that the mixture can be too lean. From this results high nitrogen oxide emissions and combustion misfires when the mixture is leaned to the lean-running limit. During start, the lambda probes, as a rule, are not operationally ready so that the lambda control cannot compensate for this effect. The reason for the leaning at high temperatures in the fuel distributor or in the region of the fuel injection valve are the following: a change of the fuel density when warming; a changed delay time of the injection valves as a consequence of higher coil internal resistance; and, vapor droplet formation.

The mixture precontrol can be improved when the temperature of the fuel distributor or the valve is considered in the computation of the injection times. A sensor for temperature detection is, however, complex. Therefore, it is necessary to show possibilities with which the temperature at the injection valve or in the fuel distributor can be detected without additional sensors especially for a start of the engine.

According to the invention, it has been recognized that interventions of the fuel adaptation are repeatedly to be attributed to the fact that the actual opening times of the magnetic valve do not correspond to the desired inputs, that is, the desired quantity of fuel is not supplied to the combustion chambers. Furthermore, as a significant reason for these deviations, the fact was identified that the opening time of the magnetic valve is considerably dependent upon its temperature. This, in turn, is attributed to the fact that the magnetic coil of the magnetic valve (constant battery voltage as a condition precedent) has less power at higher temperatures than at lower temperatures.

At high temperature, the magnetic valve therefore needs more time to open (therefore, this effect is precisely counter to the temperature-dependent viscosity of the fuel and the corresponding correction in the state of the art in view of the injected fuel quantity). At high temperature of the magnetic valve, there is therefore less fuel injected than required, that is, the mixture therefore becomes too lean which provokes a corresponding intervention of the mixture adaptation. At this point, it is noted that the temperature in the engine compartment of a motor vehicle can easily reach up to 90° C. when the engine hood is closed and the vehicle is at standstill (possibly at idle). With a subsequent drop of the temperature of the magnetic valve, too much fuel is injected which likewise permits the mixture adaptation to become active.

This effect is especially clear for charged internal combustion engines (wherein the intake air is precompressed). Because of the large charge differences present there between idle and full load, injection valves must be used having a large injection time ratio and, absolutely seen, very short minimum injection times. Especially for very short injection times (that is, for example, at idle), the above-mentioned temperature drift becomes, however, especially noticeable.

If there is such a temperature drift and a corresponding becoming active of the mixture adaptation, then already a portion of the tolerance band of the monitoring of the mixture adaptation is consumed wherein the tolerance band is fixed by the limits. If additional mixture relevant disturbances occur, which require an intervention of the mixture adaptation, which would per se still lie within the permitted tolerances, then the limits can be exceeded in toto. Thus, a fault announcement would be generated notwithstanding a mixture preparation system disposed within the fixed tolerances.

If, however, and as provided in accordance with the invention, the temperature dependency of the opening characteristics of the magnetic valve is considered in advance in the determination of the valve opening times, then the temperature of the magnetic valve has no effect or only a slight effect on the actual mixture. In this case, the mixture adaptation need carry out no or only slight interventions caused by the temperature dependency of the magnetic valve so that the tolerance band of the monitoring of the mixture adaptation is available substantially for mixture deviations which have other causes, preferably system relevant causes. Finally, fault announcements of system failures can be clearly reduced or even entirely avoided.

The method operates very simply and cost effectively because, for the determination of the temperature of the magnetic valve, a temperature is used which is anyway measured. Accordingly, no additional sensors are required. The method can therefore be implemented exclusively with software.

A first embodiment is characterized in that the temperature of the coil of the magnetic valve is modeled from the determined temperature and the drive duration is corrected in dependence upon the coil temperature.

According to the invention, it was recognized that the determined temperature of the magnetic valve need in no way correspond to the temperature of the coil of the magnetic valve. For example, the nozzle of the injection valve adjusts very rapidly to a temperature which is made up from a convective heat transfer from the intake air passing over the nozzle and a heat-conducting component of the engine block or of the cylinder head. The nozzle has a relatively low mass. The magnetic coil of the magnetic valve, however, adjusts to a temperature which takes place almost exclusively from heat conduction, for example, via a valve seat, a valve needle, a bearing, et cetera.

Especially with dynamic operations, the temperature of the coil of the magnetic valve will differ from the temperature of other regions of the magnetic valve. As an example, a situation is mentioned wherein a motor vehicle having such an internal combustion engine is operated after a full gas throttle for a longer time at idle. Because of the hot engine, the intake manifold is heated up which can lead to a rapid temperature increase of the intake air up to 90° C. The nozzle or the nozzle tip of the magnetic valve will very rapidly adjust to a new higher temperature; whereas, the coil of the magnetic valve will have a higher temperature only very slowly.

This effect is countered by the measures according to the invention.

In the method of the invention, not only is the temperature of the magnetic valve modeled overall, but the temperature of the coil is also modeled. The correction of the drive duration, which takes place on the basis of the temperature of the coil, is therefore significantly more precise and leads to a more optimal and adapted injection duration, even for rapid changes.

To determine the temperature of the magnetic valve, preferably the temperature of the intake air and/or the temperature of the engine are used. With respect to the engine, especially the temperature of the cylinder head or of the intake manifold or the temperature of cooling water or cooling air is used. These two temperature values are temperatures which are anyway determined in general. These signals are therefore present without additional complexity.

It is also possible that the temperature of the internal combustion engine and the temperature of the intake air are weighted. The influence of the temperature of the internal combustion engine, on the one hand, and the temperature of the intake air, on the other hand, on the temperature of the magnetic valve or of the coil of the magnetic valve can be different depending upon the built-in situation of the magnetic valve, the material used, the distance of the temperature sensor from the magnetic valve, et cetera. The influence of the temperature of the intake air is paramount if the magnetic valve is thermally insulated, for example, relative to the cylinder head or the intake manifold. This is taken into account by the given embodiment.

For higher throughput, that is, for example, at high rpm or low rpm and greater load, the speed with which the intake air passes over the nozzle of the magnetic valve is greater. In this case, the heat transfer from the intake air to the nozzle of the magnetic valve is greater so that in such operating states of the engine, the temperature of the inducted air has a greater influence on the temperature of the nozzle of the magnetic valve. This can be considered in that the weighting is dependent upon the rpm and/or dependent upon the load in such a manner that, at high rpm and/or load, the temperature of the intake air is weighted more.

A simple model with which the temperature of the coil can be determined from the temperature of the magnetic valve includes a lowpass filter.

From the determined coil temperature, an additional valve delay time can be determined in a simple manner. This can be equal to zero at a specific standard temperature which is preferably a minimum temperature of the coil occurring usually in operation. At a higher temperature than the standard temperature, a valve delay time is determined which is considered in the computation of the opening time point of the magnetic valve.

The opening time of the magnetic valve is not only dependent upon the temperature of the coil but also on the voltage of the connected battery. The valve delay time is therefore especially precise when the additional valve delay time is added to a battery voltage-dependent valve delay time.

The invention relates also to a computer program which is suitable for carrying out the above method when it is executed on a computer. It is especially preferable when the computer program is stored on a memory, especially on a flash memory.

The invention relates finally to an internal combustion engine which includes: a magnetic valve which has a coil and which meters fuel; means for determining the temperature of a region of the magnetic valve; a control apparatus (open loop and/or closed loop). The control apparatus is connected at its output end to the magnetic valve and influences the injected fuel quantity by means of the duration of the drive of the magnetic valve and corrects the drive duration in dependence upon temperature.

In order to make this temperature-dependent correction more precise, the suggestion is made in accordance with the invention that: a temperature of the magnetic valve is determined by the control apparatus from at least one usually measured temperature; the control apparatus so corrects the drive duration in dependence upon the determined temperature that the temperature dependency of the characteristics of the magnetic coil of the magnetic valve is considered.

In an especially advantageous manner, a model for modeling the time-dependent performance of the fuel rail temperature or the injection valve temperature is given via which the temperature can be precisely and simply determined for a renewed start of the engine after a switchoff. With this model, various requirements are satisfied. The model determines temperature values in a temperature range greater than 65° C. which is relevant for a hot start. It has been shown that leaning effects as described above only occur in this temperature range. In this way, the model permits a reliable detection of hot start conditions because the above-mentioned temperatures are reached only during the hot shut-off phase. Furthermore, it is ensured by the model that, in normal driving operation, the model temperature does not incorrectly climb above this threshold value. The result is therefore a temperature model which precisely and reliably models the temperature of the rail or the valves and can be easily applied.

The computation of the injection quantities is corrected in an advantageous manner by the modeled temperature for a start of the internal combustion engine. In this way, the leaning effect is effectively compensated also when starting after different operating sequences (for example, after a long idle phase) with an immediate drive, et cetera.

BRIEF DESCRIPTION OF THE DRAWING

In the following, an embodiment of the invention is explained in detail with reference to the attached drawing. In the drawing.

DESCRIPTION OF THE PREFERRED EMBODIMENTS OF THE INVENTION

Figure 1:
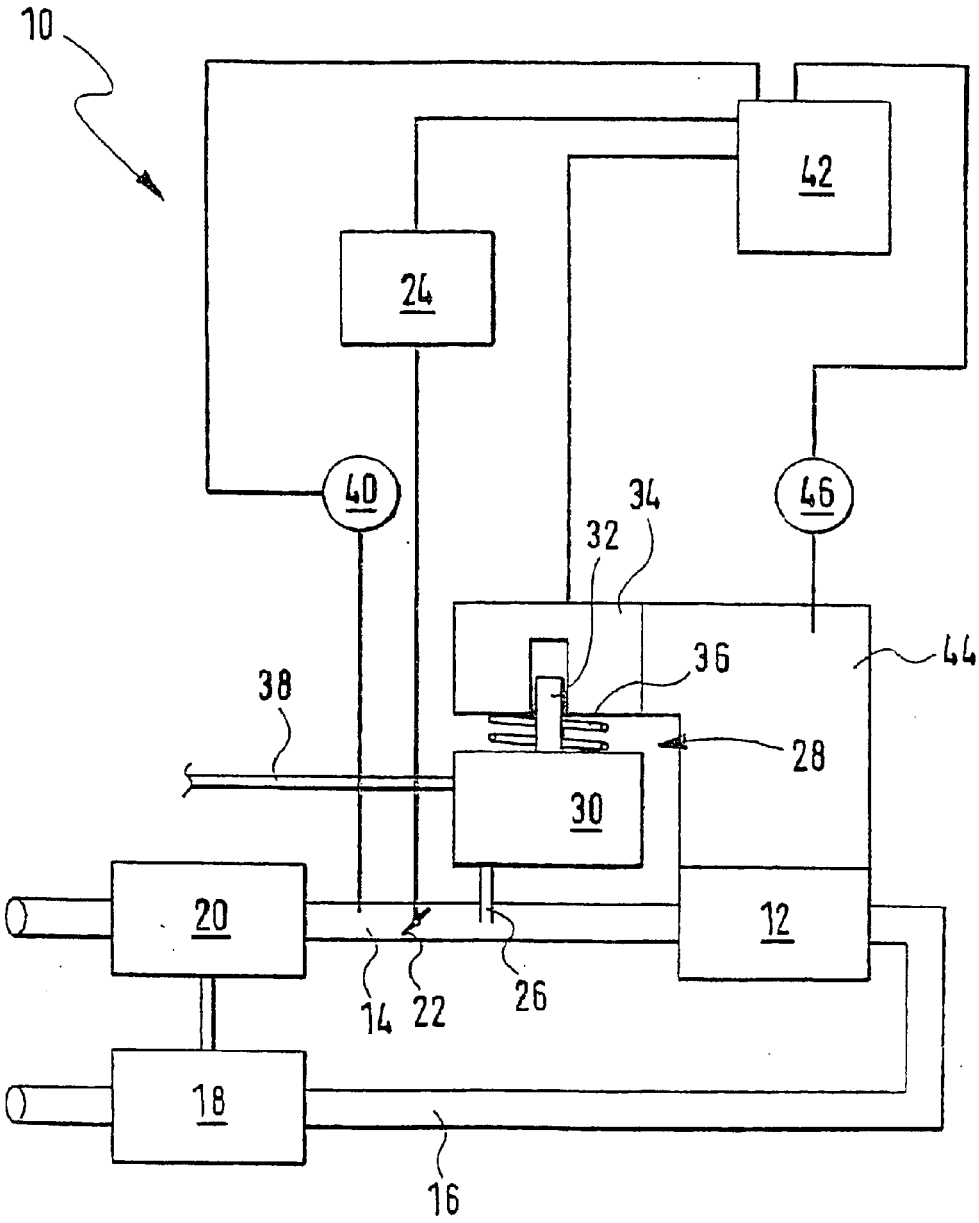
FIG. 1 shows a block diagram of an internal combustion engine.

In FIG. 1, an internal combustion engine overall is identified by reference numeral 10. The engine includes a combustion chamber 12 to which an air/fuel mixture is supplied via an intake manifold 14. The exhaust gases are conducted away from the combustion chamber 12 via an exhaust-gas pipe 16.

A turbine 18 is mounted in the exhaust-gas pipe 16 and is driven by the exhaust gas transported in the exhaust-gas pipe 16. The turbine 18 is connected via a shaft to a compressor 20 which is mounted in the intake manifold 14. When a specific load is requested, the air in the intake manifold 14 is precompressed by the compressor 20.

A throttle flap 22 is provided in the intake manifold 14 between the compressor 20 and the combustion chamber 12. The throttle flap is moved by an actuating motor 24. A nozzle 26 of a magnetic valve 28 is disposed in the intake manifold 14 between throttle flap 22 and combustion chamber 12. The magnetic valve 28 includes a valve body 30 which is connected to an armature 32. The armature 32 is, in turn, charged by a coil 34 and is pretensioned relative to the coil by a spring 36. The magnetic valve 28 is connected to a fuel supply 38.

The temperature of the intake air between the compressor 20 and the throttle flap 22 is tapped by an intake air temperature sensor 40 which outputs a corresponding signal to a control apparatus (open loop and closed loop) 42. The combustion chamber 12 is, inter alia, delimited by a cylinder head 44 whose temperature is detected by a cylinder head temperature head sensor 46 which outputs a corresponding signal to the control apparatus 42. The magnetic valve 28 is attached to the cylinder head 44. Alternatively, for example, the temperature of the cooling water could also be detected. Furthermore, the injection valve could also be attached to the intake manifold 14.

The internal combustion engine 10 is operated as follows (see also FIGS. 2 and 3).

In operation, combustion air is supplied via the intake manifold 14 to the combustion chamber 12. The combustion air is precompressed by the compressor 20 in specific operating states, for example, at high load. Fuel is injected into the flow of combustion air by the nozzle 26 so that an air/fuel mixture reaches the combustion chamber 12 and is there ignited. The quantity of the fuel to be injected is determined by the control apparatus 42 in dependence upon an air mass which, for example, is detected by an air mass sensor (not shown in the figure).

If a high torque is requested, then the magnetic valve 28 is so driven by the control apparatus 42 that it is open for a longer time span. In contrast, at idle, the magnetic valve 28 is so driven that it is opened only very briefly. The bandwidth of the opening times of the magnetic valve 28 is especially large for the internal combustion engine 10, which has a compressor 20, because the charge of the combustion chamber with air can be very different because of the presence of the compressor 20.

Especially for charged engines, that is, also for the internal combustion engine 10 having a turbocharger as shown in the present embodiment, the injection times are therefore especially short during idle. Inaccuracies in the dimensioning of the injection times are therefore very noticeable in these cases. Such a defective dimensioning of the injection time can, for example, be caused by the temperature dependency of the actuating force of the coil 34 of the magnetic valve 28.

At high temperatures of the coil 34, the actuating force (constant battery voltage is a condition precedent), which can be generated by the coil 34, is less than for a lower temperature of the coil 34. This has the consequence that, when the control apparatus 42 activates the coil 34 at high temperature, the armature 32 is pulled with a lower force so that the valve body 30 moves more slowly away from the valve seat (not shown), that is, the magnetic valve 28 opens overall more slowly. In this way, less fuel arrives in the intake manifold 14 within an opening time of the magnetic valve 28 pregiven by the control apparatus 42 whereby the internal combustion engine 10 is operated at too lean a mixture. If the temperature of the coil 34 is known, the slower opening performance can be countered either with an earlier opening or a later closing of the valve. This takes place as follows (see FIG. 2) in the present internal combustion engine 10.

The temperature tans of the intake air (block 48), which is measured by the intake air temperature sensor 40, and the temperature tmot of the cylinder head 44 (block 50), which is measured by the cylinder block temperature sensor 46, are supplied to a characteristic field (block 52). In this way, the temperature evtmod of the nozzle 26 of the magnetic valve 28 is determined (block 53). If required, the input quantities tans (block 48) and tmot (block 50) are supplied weighted to the characteristic field (block 52) whereby the differently strong influence of the input quantities tans and tmot on the temperature evtmod of the nozzle 26 of the magnetic valve 28 can be considered. It is also possible to configure the weighting in dependence upon rpm.

The modeled temperature evtmod of the nozzle 26 of the magnetic valve 28 is now fed into a filter 54. The filter is, however, only active when a bit B_stend (block 56) is set. This is, in turn, then the case when a specific minimum rpm of the engine 10 is present. The filter 54 is a lowpass filter which is initialized with the modeled temperature evtmod of the nozzle 26 of the magnetic valve 28.

Because of this filtering in filter 54, one obtains a value evtmodev in block 58 which corresponds to the temperature of the coil 34 of the magnetic valve 28. The trace of the temperature evtmodev of the coil 34 compared to the course of the temperature evtmod of the nozzle 26 of the magnetic valve 28 is plotted in FIG. 3.

From this, it is evident that an increase of the temperature evtmod of the nozzle 26 of the magnetic valve 28 (caused, for example, by a warming of the engine compartment during idle after high power was outputted by the engine) causes only a slow warming of the coil 34 whose temperature value evtmodev therefore only approaches the value evtmod slowly and asymptotically. This corresponds in good approximation to the actual course of the temperature of the coil 34 of the magnetic valve 28 because the temperature thereof is adjusted essentially exclusively by heat conductivity from the nozzle 26 and, on the other hand, from the cylinder head 44 or the intake manifold 14.

Figure 2:
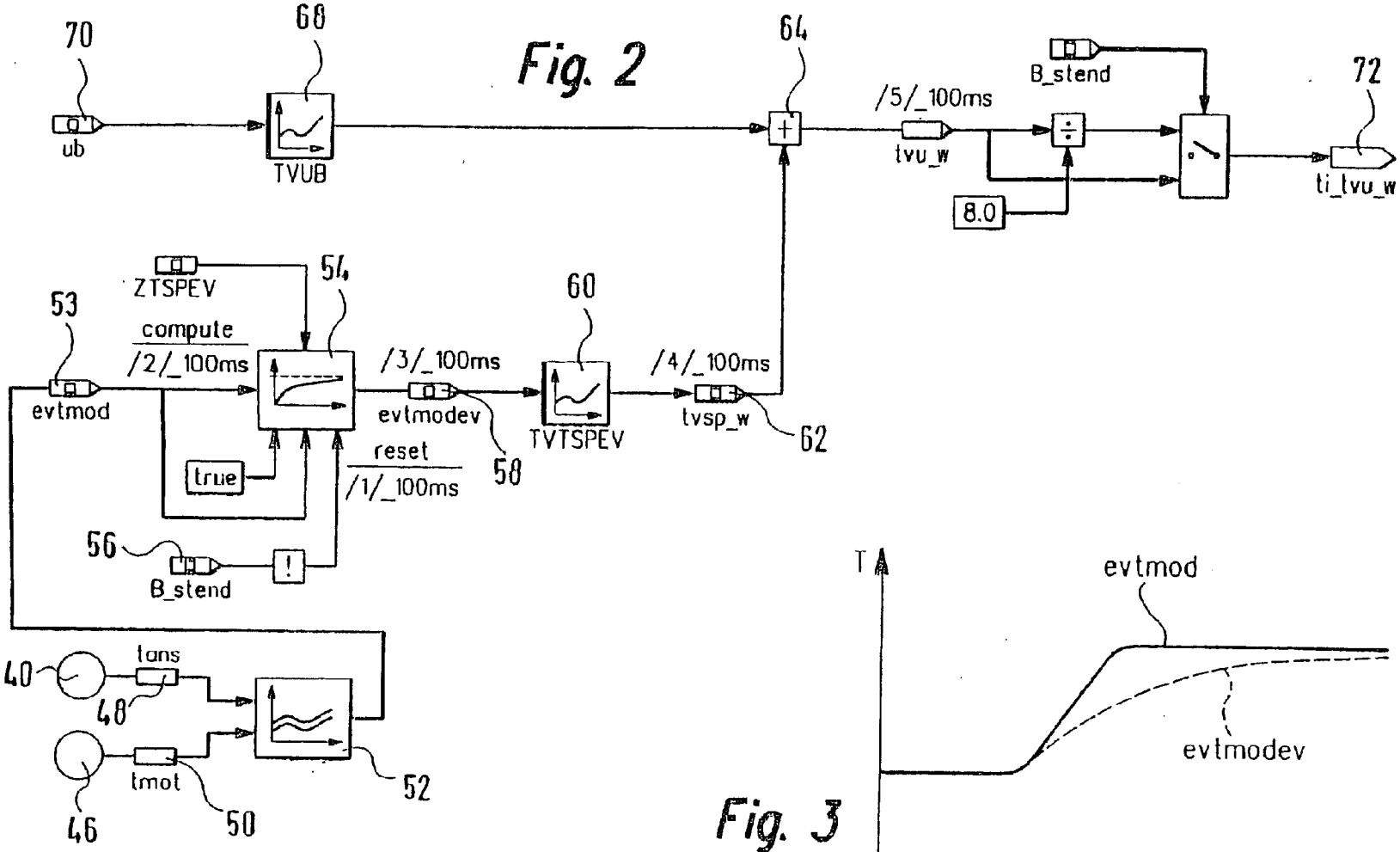
FIG. 2 shows a flowchart of a method for operating the internal combustion engine of FIG. 1.

As shown in FIG. 2, the temperature evtmodev of the coil 34 is fed in block 60 into a characteristic line TVTSPEV. In this way, one obtains in block 62 a valve delay time tvsp_w based on the modeled temperature of the coil 34. This valve delay time tvsp_w is coupled additively in block 64 with a value tvu_w (block 66). The value tvu_w is obtained in block 68 from a characteristic line TVUB into which the battery voltage ub (block 70) is fed. Finally, in block 72 a correction ti_tvu_w of the injection time is obtained. With this corrective value, on the one hand, the dependency of the opening speed of the magnetic valve 28 on the battery voltage ub is considered and, on the other hand, the dependency on the temperature evtmodev of the coil 34 of the magnetic valve 28 is considered.

In total, a more precise composition of the air/fuel mixture in the combustion chamber 12 is made possible with the described internal combustion engine 10 and the method shown in FIG. 2 without additional sensors being required. This, in turn, means that interventions of the mixture adaptation, which are caused by a drift of the temperature of the magnetic valve or of the magnetic coil 34 thereof, are not required or are required only to a slight extent. Defective triggering of the monitoring of the mixture adaptation is thereby reliably avoided.

Although an internal combustion engine having a turbocharger was described above, the described method is, however, also suitable to the same extent for internal combustion engines without precompression. The method is also suitable for internal combustion engines having gasoline-direct injection, that is, without intake manifold injection.

For the determination of the temperature of rail or of the injection valve(s) (in the following, only rail temperature is mentioned) also after switchoff of the engine, a temperature model is utilized in a preferred embodiment and this temperature model is described in greater detail in the following. The above-described leaning effect is effective only for rail or valve temperatures above approximately 65° C. These high temperatures do not occur in the driving state because of the afterflow of cold fuel or because of the blower cooling; rather, these high temperatures are reached only during a so-called hot shut-off phase. For this reason, the model must satisfy special requirements, namely: a modeled rail temperature for values greater than 65° C. must be made available and a reliable detection of hot start conditions must be guaranteed and it must be ensured that, during driving operation, the model temperature does not erroneously increase above the mentioned threshold value.

Figure 4:
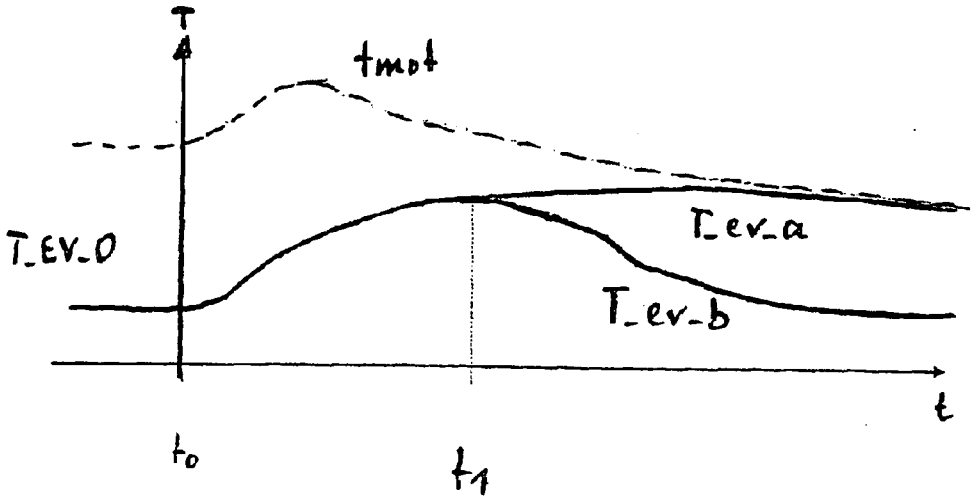
FIG. 4 is a diagram wherein the time-dependent course of difference temperatures are shown after the switch off of the internal combustion engine.

In FIG. 4, a time diagram is shown which explains the time-dependent course of the rail temperature and the modeling requirements derived therefrom. The engine temperature tmot is plotted as a function of time and the (modeled) rail temperature T_ev is plotted as a function of time and are shown by broken lines. The rail temperature is shown as T_ev_a when, within the illustrated time, the engine is not started and as T_ev_b when the engine is started. During normal driving operation, the rail temperature lies below a specific temperature threshold (in some cases 65° C.). In the model, a constant temperature T_ev_0 is set for this range (ahead of the time point t0). After shutting off the engine at time point t0, the rail temperature slowly approaches the engine temperature. First, both temperatures increase and then the engine temperature drops slowly while the rail temperature approaches the engine temperature with time. In this way, a delaying behavior in the sense of a PT1-characteristic (lowpass characteristic) is observed. If the engine is started at time point t1, then the rail temperature T_ev_b again moves away from the engine temperature and moves toward the operating temperature T_ev_0, which is assumed constant, at a more rapid time constant. If no engine start takes place, then rail temperature and engine temperature become coincident after a certain time (see trace of T_ev_a).

The temperature model uses weighting factors for the warming and for the cooling of the rail. These weighting factors are independent of each other. In one embodiment, the following mathematical formulation of the model has been shown to be suitable:

$$T_ev = T_ev_0 + (tmot + T_ev_0) * (WF1 * WF2)$$

wherein: T_*ev* is the modeled temperature of the rail (of the injection valves); T_*ev*_0 is an operating temperature assumed as constant; tmot is the engine temperature; WFl is the weighting factor for the warmup; and, WF2 is the weighting factor for the cool down.

The effects of the warmup and cool down are separated in the form of two weighting factors WF1 and WF2 which are independent of each other. This characteristic facilitates the application of the model for operating conditions which deviate greatly from each other such as, for example, short and long shut-off times. The model start is understandable when one considers the operation of the product of the two weighting factors WF=WF1*WF2. The permissible value range of the factors, and therefore also of the product, lies in the range between 0 and 1. Between the two temperature values T_ev_0 and tmot, a linear change takes place in dependence upon this product.

Figure 5:
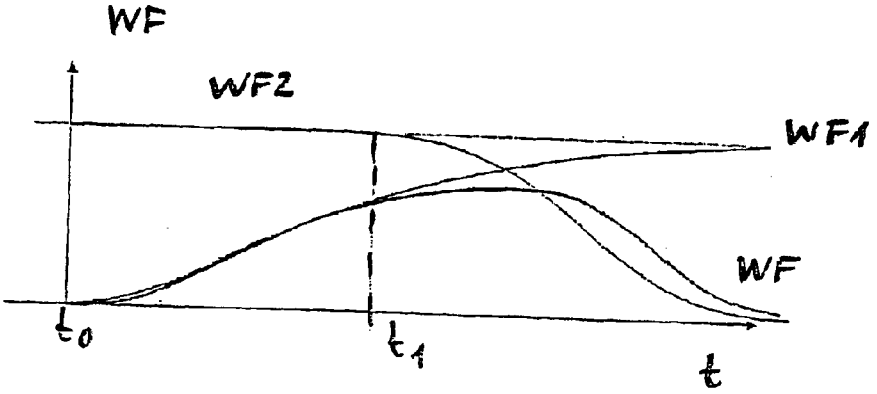
FIG. 5 is a diagram showing the course of the weighting factors WF of the temperature model used plotted as a function of time; and, FIG. 6 is a sequence diagram which represents a program for modeling the injection valve temperature or rail temperature and the correction of the injection time.

FIG. 5 schematically shows an example for the traces of the weighting factors for an actual application wherein the situation shown in FIG. 4 forms the basis. At the switch-off time point of the engine at time point t0, the warmup weighting factor WF1 is initialized with the value 0 and the weighting factor WF2 is initialized with the value 1. At this time point, the product of the weighting factors is 0 so that the operating temperature T_ev_0 results as the rail temperature. Thereafter, the warm-up factor WF1 is controlled slowly to the end value 1 with time in accordance with a time function; whereas, the factor WF2 is held at the initialized value 1 up to the renewed start of the engine at time point t1. If the engine is not started, then the temperature of the injection valves moves in correspondence to the factor WF1 toward the engine temperature tmot. This temperature is detected by a temperature sensor and is available. The increase of the weighting factor WF1 takes place in dependence upon the switchoff duration, that is, the time which elapses since the switchoff of the engine. From the start time point of the engine on, the weighting factor WF2 for the cool down is controlled down to the end value 0 in accordance with a time function starting from the initialization value. In this way, also the total factor WF is controlled down to the value 0. The control down speed of the cool down weighting factor is advantageously controlled in dependence upon the following: the fuel mass which flows after in the rail since the start; the blower cooling; and, the road speed. All these quantities are present. The result is a simple, precise simulation of the temperature of the rail or of the injection valves which adequately precisely reflects the actual conditions.

Figure 6:
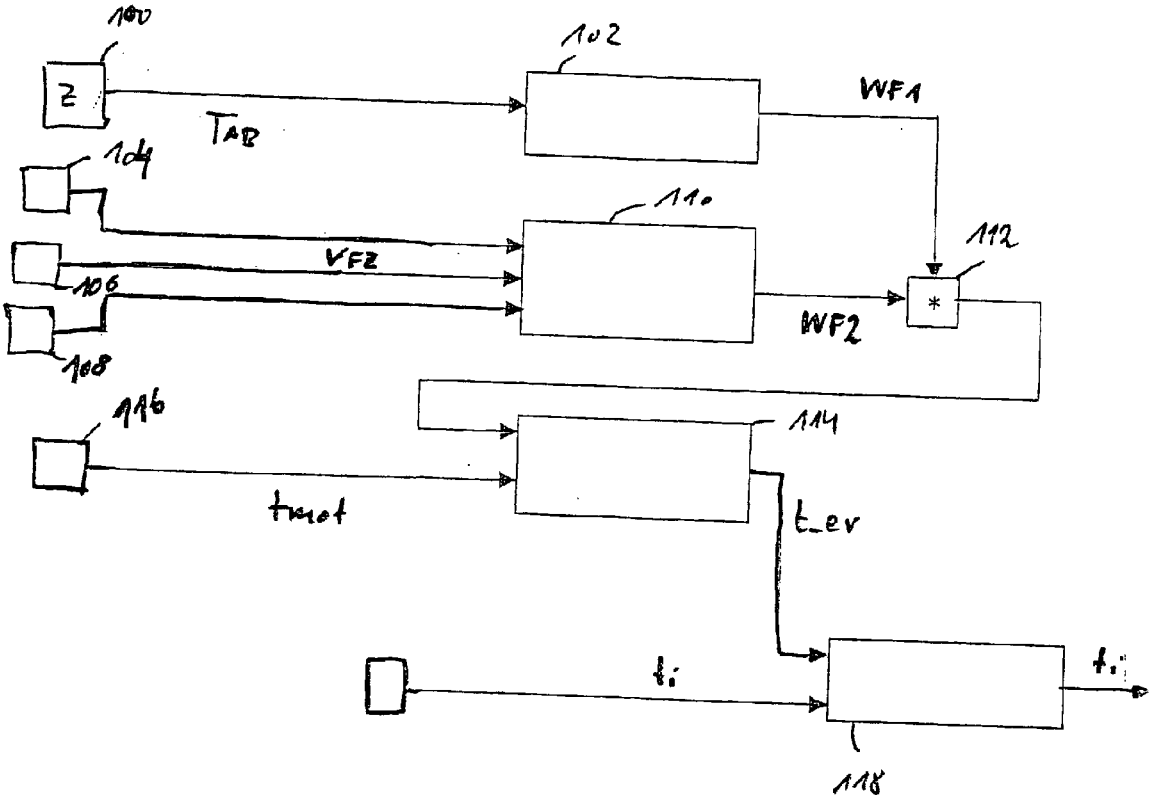

In FIG. 6, a sequence diagram is shown which serves as an example for an algorithm for computing the modeled temperature. The algorithm represents a program which runs in the microcomputer of a control unit for controlling the engine.

First, after the shut-off of the engine, for example, by means of a counter 100, the shut-off time TAB is determined and is evaluated in 102 for determining the warm-up weighting factor WF1. The start time point of the counter is, for example, the rotation of the ignition key into a switch-off position and/or the reduction of the engine rpm below a minimum threshold. The weighting factor WF1 is formed in accordance with a time function with the shut-off time as a parameter, for example, an exponential function. Furthermore, in 104, the fuel mass, which is injected since the engine start, is determined, for example, by summing the outputted injection pulse lengths since engine start. In 106, the road speed is determined and in 108, the blower power. The blower power results, for example, from the time duration of the drive of the blower, if needed, in addition to its rpm. From these quantities, the weighting factor WF2 for the cool off is determined in 110. This takes place in one embodiment by means of a characteristic field. The weighting factor becomes that much smaller the greater the fuel quantity is since engine start and the greater the road speed is and the greater the blower power is.

The two weighting factors are multiplied by each other in the multiplication position 112 and the product is supplied to the model 114. The engine temperature tmot, which is determined in the measuring device 116, is also supplied to the model 114. The model 114 then determines the temperature t_ev of the rail or of the injection valves in accordance with the computation equation shown above. This temperature is then evaluated in 118 for the correction of the computed injection time. The injection time ti is determined in dependence upon load and rpm in a manner known per se and supplied to the corrective location 118. There, a corrective factor, preferably in accordance with a characteristic line, is formed in dependence upon the determined temperature t_ev. In one embodiment, the corrective factor is so selected that it is greater than 1 at temperatures T_ev greater than a pregiven threshold value (for example, 65° C., T_ev_0) and is 1 below this pregiven threshold value (no correction). In this way, hot start situations are reliably detected and considered. In 118, the injection time ti is then multiplicatively corrected for forming the resulting injection time ti. Especially the effect of the fuel density, which reduces with increasing fuel temperature or rail temperature, is corrected while the extension of the delay time of the valve is corrected with increasing coil temperature by an additive correction as described above. These measures are utilized individually or together so that the injection time is multiplicatively and/or additively corrected in dependence upon a temperature dependent factor.

Figure 3:
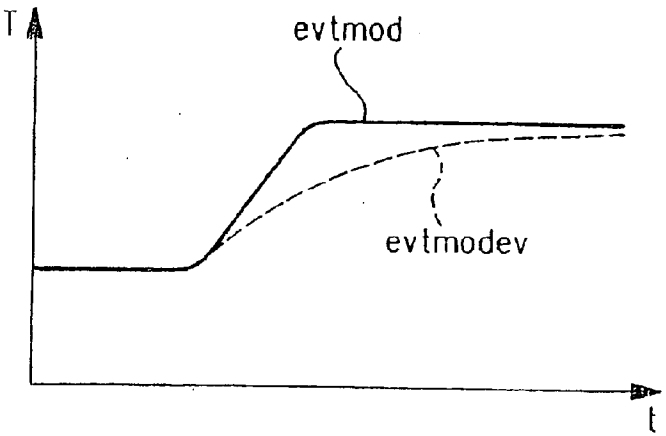
FIG. 3 shows a diagram in which the temperature of a nozzle of a magnetic valve of the internal combustion engine of FIG. 1 and the temperature of a coil of this magnetic valve are plotted as a function of time.

In one embodiment, the correction of the injection time in the start phase is carried out in accordance with the above sketched model; whereas, during the subsequent driving operation, the correction is carried out in accordance with the procedure described with respect to FIGS. 1 to 3. In other embodiments, either the one or the other solution is utilized.

What is claimed is:

1. A method for operating an internal combustion engine wherein the fuel is supplied via a magnetic valve having a coil, the method comprising the steps of:

influencing the injected fuel quantity by the duration of the drive of the magnetic valve; and, modeling the temperature (evtmod) of the magnetic valve from at least one usually measured temperature (tans, tmot) and correcting (tvsp_w) the drive duration (ti_tvu_w) in dependence upon the modeled temperature (evtmod) and the temperature dependency of the characteristics of the magnetic coil of the magnetic valve.

2. A method for operating an internal combustion engine wherein the fuel is supplied via a magnetic valve having a coil, the method comprising the steps of:

influencing the injected fuel quantity by the duration of the drive of the magnetic valve;

modeling the temperature (evtmod) of the magnetic valve from at least one usually measured temperature (tans, tmot) and correcting (tvs_w) the drive duration (ti_tvu_w) in dependence upon the modeled temperature (evtmod) and the temperature dependency of the characteristics of the magnetic coil of the magnetic valve; and, wherein the temperature (evtmodev) of the coil of the magnetic valve is modeled from the determined temperature (evtmod) and the drive duration (ti_tvu_w) is corrected (tvsp_w) in dependence upon the coil temperature (evtmodev).

3. The method of claim 2, wherein the temperature (tans) of the intake air and/or the temperature (tmot) of the internal combustion engine is used to determine the temperature (evtmod) of the magnetic valve.

4. The method of claim 3, wherein the temperature (tmot) of the internal combustion engine and the temperature (tans) of the intake air are used weighted.

5. The method of claim 4, wherein the weighting is dependent upon the rpm and/or load in such a manner that, at high rpm and/or load, the temperature of the intake air is weighted more.

6. The method of claim 1, wherein the model for determining the coil temperature includes a lowpass filter.

7. The method of claim 1, wherein an additional valve delay time (tvsp_w) is determined from the determined coil temperature (evtmodev).

8. The method of claim 7, wherein the additional valve delay time (tvsp_w) is added to a battery voltage dependent valve delay time (tvu_w).

9. A method for operating an internal combustion engine, the method comprising the steps of:

supplying fuel via a magnetic valve with the injected fuel quantity being influenced by the duration of the drive of the magnetic valve;

determining the temperature of the magnetic valve in accordance with a model which, starting from an operating temperature, simulates the warmup operation when switching off the engine and the cool down operation when restarting the engine; and, correcting the drive duration in dependence upon the temperature of the magnetic valve.

10. The method of claim 9, wherein the temperature model includes a first weighting factor for the warmup and a second weighting factor for the cool down when restarting.

11. The method of claim 10, wherein the weighting factor for the warmup is dependent upon the shut-off time and the weighting factor for the cool down is dependent upon the injected fuel mass after restart and/or on the engine blower power and/or the vehicle road speed.

12. A computer program comprising a method for operating an internal combustion engine when said computer program is executed on a computer, the method including the steps of:

influencing the injected fuel quantity by the duration of the drive of the magnetic valve; and, modeling the temperature (evtmod) of the magnetic valve from at least one usually measured temperature (tans, tmot) and correcting (tvsp_w) the drive duration (ti_tvu_w) in dependence upon the modeled temperature (evtmod) and the temperature dependency of the characteristics of the magnetic coil of the magnetic valve.

13. The computer program of claim 12, wherein the computer program is stored in a memory including a flash memory.

14. An arrangement for operating an internal combustion engine, the arrangement comprising:

a control unit, which influences the injected fuel quantity via the duration of the drive of the magnetic valve and which determines the temperature of a region of the magnetic valve or of the fuel distributor and which corrects the drive duration in dependence upon temperature; and, the control unit including a model for determining the temperature of the magnetic valve or of the fuel distributor from at least one usually measured temperature and said model further correcting the drive duration in dependence upon the determined temperature.

15. An internal combustion engine comprising:

a magnetic valve which supplies fuel and the magnetic valve including a coil;

means for determining the temperature (evtmod) of a region of the magnetic valve;

a control, apparatus connected at its output end to the magnetic valve;

said control apparatus including means for influencing the injected fuel quantity by the duration of the drive of the magnetic valve and means for correcting the drive duration in dependence upon temperature;

said control apparatus including means for modeling a temperature (evtmod) of the magnetic valve from at least one usually measured temperature (tans, tmot); and, said control apparatus including means for correcting the drive duration (ti_tvu_w) in dependence upon the modeled temperature (evtmod) and the temperature dependency of the characteristics of the magnetic coil of the magnetic valve.

* * * * *

UNITED STATES PATENT AND TRADEMARK OFFICE

CERTIFICATE OF CORRECTION

PATENT NO. : 6,877,487 B2
DATED : April 12, 2005
INVENTOR(S) : Bernhard Vogt et al.

It is certified that error appears in the above-identified patent and that said Letters Patent is hereby corrected as shown below:

Title page,
Item [30], Foreign Application Priority Data, delete "101 51 550" and insert -- 100 51 550 -- therefor.

Column 10,
Line 51, delete "(tvs_w)" and insert -- (tvsp_w) -- therefor.

Column 12,
Line 26, delete "control," and insert -- control -- therefor.

Signed and Sealed this

Fourteenth Day of June, 2005

JON W. DUDAS
*Director of the United States Patent and Trademark Office*